US011678730B2

(12) United States Patent
Varghese et al.

(10) Patent No.: US 11,678,730 B2
(45) Date of Patent: Jun. 20, 2023

(54) HAIR CARE DEVICE

(71) Applicant: KONINKLIJKE PHILIPS N.V., Eindhoven (NL)

(72) Inventors: Babu Varghese, Eindhoven (NL); Marco Baragona, Eindhoven (NL); Jonathan Alambra Palero, Eindhoven (NL); Johan Lub, Eindhoven (NL); Wouter Hendrik Cornelis Spoorendonk, Eindhoven (NL); Tim Tielemans, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/768,583

(22) PCT Filed: Nov. 7, 2016

(86) PCT No.: PCT/EP2016/076852

§ 371 (c)(1),
(2) Date: Apr. 16, 2018

(87) PCT Pub. No.: WO2017/080957

PCT Pub. Date: May 18, 2017

(65) Prior Publication Data

US 2018/0310685 A1 Nov. 1, 2018

(30) Foreign Application Priority Data

Nov. 10, 2015 (EP) ..... 15193979

(51) Int. Cl.
*A45D 1/04* (2006.01)
*A45D 1/06* (2006.01)
(Continued)

(52) U.S. Cl.
CPC ..... *A45D 1/04* (2013.01); *A45D 1/06* (2013.01); *A45D 1/28* (2013.01); *A45D 2/001* (2013.01); *A45D 2200/205* (2013.01)

(58) Field of Classification Search
None
See application file for complete search history.

(56) References Cited

U.S. PATENT DOCUMENTS 4,792,341 A * 12/1988 Kozikowski ..... A61Q 5/08 8/103
5,303,722 A * 4/1994 Godfrey ..... A45D 24/10 132/219

(Continued)

FOREIGN PATENT DOCUMENTS

FR 2979202 A1 3/2013
JP 2005177234 A 7/2005

(Continued)

OTHER PUBLICATIONS

Aleksey Kharin, Babu Varghese, Rieko Verhagen, and Natallia Uzunbajakava, "Optical properties of the medulla and the cortex of human scalp hair", Journal of Biomedical Optics, 14, 024035 (2009).

*Primary Examiner* — Tatiana L Nobrega

(57) ABSTRACT

A hair care device (100) comprises a heat source (103) for heating hair up till a first temperature that is no more than 150° C. (and thus lower than a critical temperature at which hair cuticle damage will occur), and a radiation source (102) for—in combination with heat from the heat source (103)—selectively heating a hair cortex to a second temperature exceeding the first temperature and sufficiently high for hair styling.

10 Claims, 1 Drawing Sheet

(51) Int. Cl.
*A45D 1/28* (2006.01)
*A45D 2/00* (2006.01)

(56) References Cited

U.S. PATENT DOCUMENTS

| | | | | | |
|---|---|---|---|---|---|
| 5,375,490 | A * | 12/1994 | Carlmark | B25B 13/12 | 81/129.5 |
| 5,713,961 | A * | 2/1998 | Caisey | A61Q 5/08 | 8/103 |
| 2004/0206368 | A1* | 10/2004 | Warner | A45D 2/36 | 132/200 |
| 2004/0230258 | A1* | 11/2004 | Altshuler | A61B 18/203 | 607/88 |
| 2007/0167936 | A1* | 7/2007 | Samain | A45D 19/00 | 606/9 |
| 2008/0201979 | A1* | 8/2008 | Rhoades | A45D 20/10 | 34/283 |
| 2009/0159093 | A1 | 6/2009 | Yu | | |
| 2009/0260650 | A1* | 10/2009 | Jung | A45D 1/04 | 132/224 |
| 2010/1092970 | | 8/2010 | Takahashi | | |
| 2011/0022132 | A1* | 1/2011 | Kim | A61N 5/0617 | 607/91 |
| 2011/0120487 | A1* | 5/2011 | Rollat-Corvol | A61K 8/9789 | 132/200 |
| 2011/0120491 | A1 | 5/2011 | You | | |
| 2012/0060858 | A1* | 3/2012 | Bickford | A45D 4/12 | 132/211 |
| 2012/0145178 | A1* | 6/2012 | Lombardi | A45D 20/12 | 132/211 |
| 2013/0152958 | A1* | 6/2013 | Lee | A45D 7/06 | 132/205 |
| 2015/0059798 | A1* | 3/2015 | Mazed | A45D 20/50 | 132/272 |
| 2015/0128983 | A1* | 5/2015 | Vic | A45D 7/06 | 132/204 |
| 2015/0173480 | A1* | 6/2015 | Washington | A45D 2/001 | 132/206 |
| 2015/0174031 | A1* | 6/2015 | Washington | A45D 7/06 | 132/206 |
| 2015/0174032 | A1* | 6/2015 | Washington | A45D 7/06 | 132/206 |
| 2016/0067734 | A1* | 3/2016 | Willey | B05C 9/12 | 401/195 |
| 2016/0367459 | A1* | 12/2016 | Washington | A45D 7/06 | |

FOREIGN PATENT DOCUMENTS

| | | | | | |
|---|---|---|---|---|---|
| JP | 2010131259 | A | | 6/2010 | |
| JP | 2015019854 | A | | 2/2015 | |
| KR | 20100041920 | A | | 4/2010 | |
| KR | 101157132 | B1 | | 6/2012 | |
| KR | 101470169 | B1 | | 12/2014 | |
| KR | 101502243 | | * | 3/2015 | A45D 1/18 |
| WO | WO 9410873 | | * | 5/1994 | A45D 20/20 |
| WO | 2004058187 | A2 | | 7/2004 | |
| WO | 2007134224 | A2 | | 11/2007 | |
| WO | WO-2009074957 | | * | 6/2009 | A61N 5/06 |
| WO | 2013189786 | A1 | | 12/2013 | |
| WO | 2015094839 | A1 | | 6/2015 | |

* cited by examiner

HAIR CARE DEVICE

This application is the U.S. National Phase application under 35 U.S.C. § 371 of International Application No. PCT/EP2016/076852, filed on Nov. 7, 2016, which claims the benefit of International Application No. 15193979.0 filed on Nov. 10, 2015. These applications are hereby incorporated by reference herein.

FIELD OF THE INVENTION

The invention relates to a hair care device.

BACKGROUND OF THE INVENTION

FR2979202 discloses a hair styling heating apparatus for e.g. smoothing hair, which has an arm including pinching part, which includes single red (wavelengths between 620 and 800 nm) and infrared (wavelengths above 780 nm) ray transmitter that is arranged adjacent with treatment plate, which is provided to come in contact with hairs. This is based on the idea that treatment of the hair by contact with a hot surface, substantially separate i.e. preceded or followed by a radiation makes it possible to reinforce the protection of the hair, to increase their brightness, compared to the substantially simultaneous treatments of thermal contact with radiation. The temperature of the treatment plate is between 160° C. and 240° C., preferably between 180° C. and 220° C.

Many women are concerned about the hair damage primarily resulting from styling and are sometimes dissatisfied with the results obtained from present styling devices. In addition to this, recent reports show that the most important criteria a hairdryer and straightener has to fulfil are the reduction in hair damage. In general, there is awareness that applying heat to the hair will cause damage. However, no one considers reducing or even giving up the usage of stylers, as the benefit in styling clearly outweighs the potential damage done to the hair.

SUMMARY OF THE INVENTION

It is, inter alia, an object of the invention to provide a hair care device that causes less damage to the hair. The invention is defined by the independent claims. Advantageous embodiments are defined in the dependent claims.

One aspect of the invention provides a hair care device comprises a heat source for heating hair up till a first temperature that is no more than 150° C. (and thus lower than a critical temperature at which hair cuticle damage will occur), and a radiation source for in combination with heat from the heat source—selectively heating a hair cortex to a second temperature exceeding the first temperature and sufficiently high for hair styling. Preferably, the first temperature is no more than 140° C., such as about 120° C.

Without wishing to be bound by theory, the invention is based on the following inventive insights. Hair fibers contain structures namely, the cuticle, the cortex and medulla. The cuticle is the outermost layer and surrounds the cortex which contains the major part of the fiber mass. The medulla, often found in thicker hairs, is characterized by one or more loosely packed porous regions located near the center of the fiber. The cuticle comprises flat overlapping cells (0.5-2 μm thick and 45 μm long), and cuticle layer thickness is around 10-20 μm in scalp hairs. During prior art styling (hair care devices and chemicals) this protective cuticle layer gets damaged, thereby exposing the inner structure cortex to the outside environment. The combination of heating and/or weathering with mechanical (shear) forces during styling and combing is a main cause of hair damage. Prior art electrical devices for hair styling using hot irons are designed to give a thermal treatment to the hair fibers or lock of fibers and pressing them into a determined shape. In these devices, heat flows from the outer cuticle to the inner cortex layer causing a higher temperature rise and more damage to the cuticle than to the cortex. Finally, the cortex is exposed to external weathering conditions and will eventually get damaged.

Embodiments of the invention propose devices for hair styling where the hair cortex is selectively heated, thereby preventing cuticle damage. This is based on reaching the desired maximum temperature rise for styling from the combined effect of light and contact heating, where light induced heating effects will be confined to the cortex only. The hot plates will heat the hair fibers to a temperature that is below the threshold for cuticle damage, and in combination with the heat from the hot plates, the laser will selectively heat the cortex to the desired temperature required for styling.

For selectively heating the hair cortex, a wavelength range between 400 and 600 nm, and preferably between 450 and 550 nm is optimal where absorption coefficient is maximum (and therefore less fluence is required) and also provides sufficient light penetration into the hair (~100-150 μm). By selectively heating the hair cortex using these wavelengths, heat penetrates from inside-out which helps to prevent cuticle damage and thus retain natural moisture and can seal he hair cuticle for smooth strands and ultimate shine.

These and other aspects of the invention will be apparent from and elucidated with reference to the embodiments described hereinafter.

DESCRIPTION OF EMBODIMENTS

Figure 1:
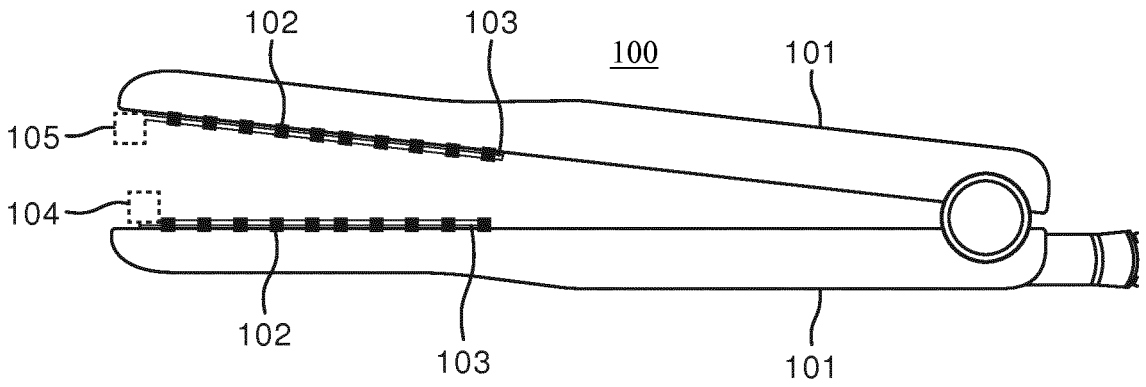
FIG. 1 shows a basic embodiment of a hair care device in accordance with the invention.

FIG. 1 shows a basic embodiment 100 of a hair care device that comprises two jaws 101 which are hinged to pinch strands of hairs. Each jaw comprises a heat source 103 formed by e.g. hot plates which are directly or indirectly heated to a first temperature T1 of e.g. 120° C. that is lower than a critical temperature Tc for cuticle damage. Each jaw comprises a radiation source (indicated by black dots 102) formed by e.g. a Continuous Wave (CW), pulsed laser source, or an Intense Pulsed Light (IPL) device with a low pass filter, for emitting a wavelength range between 400 and 600 nm, and preferably between 450 and 550 nm, which will selectively heat the cortex to a second temperature T2 of about 170° C. that is sufficiently high for styling, for a duration of about a few milliseconds to a few seconds. An array of lasers can be used too depending on the treatment area and the numbers of hairs between the jaws. The pulse duration of the laser pulse can be selected to be lower than the thermal relaxation time of the melanin granules in order to get thermal confinement in the cortex. This is consistent with the theory of selective photothermolysis, which states that the pulse duration of an emitted laser wavelength must be less than the thermal relaxation time of the targeted object. The thermal relaxation time $t \sim d^2/(16D)$ based on diffusion in the cortex cylinder is in the order of 2-3 ms. Here d is the diameter of cortex, and D is thermal diffusion coefficient. The fluence required for reaching this temperature rise inside hair cortex depends on the pigmentation/absorption coefficient of hair strands. Additional hair pigmentation sensing controls 104 can be used to measure and optimize the required fluence for selectively heating the hair by laser. The combined heating effect from hot plate 103 and laser 102 will lead to the cortex temperature reaching the temperature required for styling without the cuticle temperature becoming so hot that the cuticles will be damaged. Additional heat control systems 105 can be used to regulate the temperature settings and treatment time. To straighten/style the hairs, the strands of hairs are inserted between the plates and are moved until it is styled. To prevent shadowing effect when a lock of hairs are used, the embodiment may comprise grooves or comb like attachment which will distribute the hair more evenly resulting in homogeneous light treatment.

Figure 2:
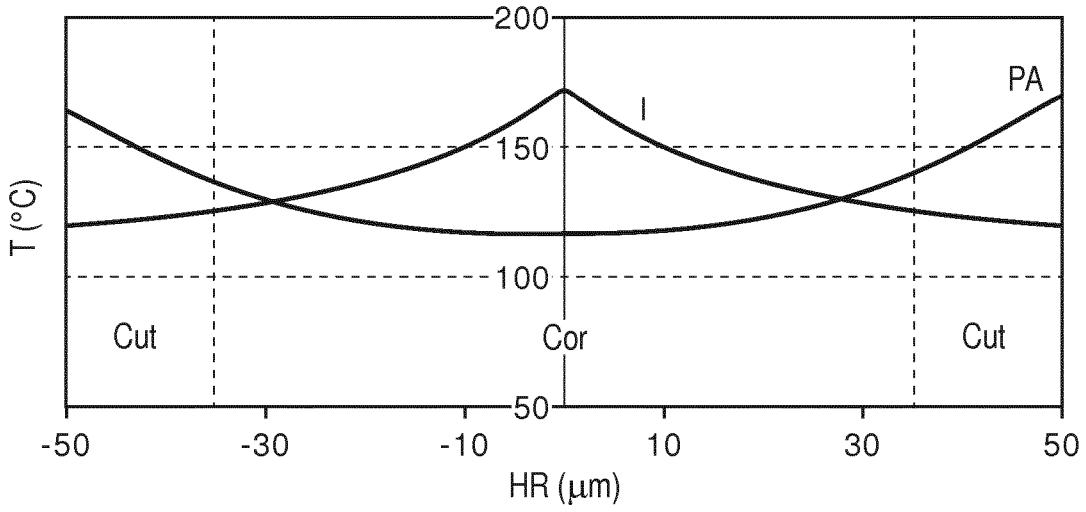
FIG. 2 compares a temperature rise in cuticle and cortex as a result of the invention with a corresponding temperature rise using a prior art solution.

FIG. 2 compares an exemplary temperature rise T in hair cuticles Cut and hair cortex Cor as a result of an embodiment of the invention (curve I) with a corresponding exemplary temperature rise using a prior art solution (curve PA) in which only heating plates are used to obtain a temperature rise that is sufficiently large to obtain a hair styling effect. On the horizontal axis the hair radius HR is indicated in μm. As is clear from FIG. 2, in the prior art (curve PA), where all heat is applied from the outside, the hair cuticles Cut will be rather hot that the hair may be damaged.

In the embodiment of the invention (curve I), the heating plates only heat the hair until a safe temperature of about 120° C., at which no damage will occur to the hair cuticles Cut. In addition to that heat, the hair is heated from the inside as a result of the radiation, so that the hair cortex Cor will become sufficiently warm to obtain a hair styling effect, while the hair cuticles Cut remain sufficiently cold so that no damage occurs.

The term hair styling as used herein is intended to encompass all actions such as hair crimping, curling, perming and straightening. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A hair care device for styling a strand of hair including a hair cuticle surrounding a hair cortex having melanin granules, the hair care device comprising:

a hinged housing having opposable parts that open and close to receive the strand of hair;

a source of heat within an opposable part of the opposable parts, wherein the source of heat is operable for heating both the hair cuticle and the hair cortex of the strand of hair;

a source of radiation arranged within the opposable part of the hinged housing, wherein the source of radiation is operable for only radiating the hair cortex of the strand of hair, wherein the source of radiation is configured to emit radiation over a duration less than a thermal relaxation time of the melanin granules to heat the melanin granules;

wherein the source of heat and the source of radiation are arranged relative to each other for a combined heating and radiating of the hair cortex of the strand of hair;

wherein the source of heat and the source of radiation are arranged to create a combined heating and radiating effect on the strand of hair such that the strand of hair is heated from the inside;

wherein, during the combined heating and radiating of the hair cortex of the strand of hair, the source of heat is configured to heat the hair cuticle of the strand of hair up to a first temperature of no more than 150° C.; and wherein, during the combined heating and radiating of the hair cortex of the strand of hair, the source of radiation and the source of heat are configured to heat the hair cortex of the strand of hair to a second temperature of more than 150° C. to about 170° C.

2. The hair care device as claimed in claim 1, wherein the first temperature is no more than 140° C.

3. The hair care device as claimed in claim 1, wherein the source of radiation is arranged for providing radiation having a wavelength between 400 and 600 nm.

4. The hair care device as claimed in claim 1, wherein the first temperature is no more than 120° C.

5. The hair care device as claimed in claim 1, wherein the source of radiation is arranged for providing radiation having a wavelength between 450 and 550 nm.

6. The hair care device as claimed in claim 1, wherein the source of radiation is arranged for providing radiation having a wavelength of 550 nm.

7. The hair care device as claimed in claim 1, wherein the source of heat comprises a hot plate.

8. The hair care device as claimed in claim 1, wherein the source of radiation is one of a continuous wave laser, a pulsed laser source, or an intense pulsed light device.

9. The hair care device as claimed in claim 1, wherein at least one of the source of heat and the source of radiation is configured for a regulated operation thereof.

10. A hair care device for styling a strand of hair including a hair cuticle surrounding a hair cortex having melanin granules, the hair care device comprising:

a hinged housing having opposable parts that open and close to receive the strand of hair;

a source of heat arranged within an opposable part of the hinged housing, wherein the source of heat is operable for heating the hair cuticle and the hair cortex of the strand of hair; and a source of radiation arranged within the opposable part of the hinged housing, wherein the source of radiation is operable for only radiating the hair cortex of the strand of hair, wherein the source of radiation is configured to emit radiation over a duration less than a thermal relaxation time of the melanin granules, and wherein the source of radiation is arranged for providing radiation having a wavelength between 400 and 600 nm; and wherein the source of heat and the source of radiation are arranged to create a combined heating and radiating effect on the strand of hair such that heat penetrates from the hair cortex to the hair cuticle by 1) heating the hair cuticle of the strand of hair up to a first temperature of no more than 150° C. by contact heating from the source of heat, and 2) heating the hair cortex of the strand of hair to a second temperature of more than 150° C. to about 170° C. by heat from the source of heat and light induced heating from the source of radiation.

* * * * *